US010667578B2

(12) United States Patent
Arzt

(10) Patent No.: US 10,667,578 B2
(45) Date of Patent: Jun. 2, 2020

(54) SHOE WITH FLEXIBLE UPPER

(71) Applicant: Janet Arzt, New York, NY (US)

(72) Inventor: Janet Arzt, New York, NY (US)

(73) Assignee: JJ SHOES LLC, New York, NY (US)

( * ) Notice: Subject to any disclaimer, the term of this patent is extended or adjusted under 35 U.S.C. 154(b) by 0 days.

(21) Appl. No.: 16/121,580

(22) Filed: Sep. 4, 2018

(65) Prior Publication Data

US 2019/0069639 A1 Mar. 7, 2019

Related U.S. Application Data

(60) Provisional application No. 62/553,321, filed on Sep. 1, 2017.

(51) Int. Cl.
*A43B 23/02* (2006.01)
*A43B 1/04* (2006.01)

(52) U.S. Cl.
CPC ..... *A43B 23/027* (2013.01); *A43B 1/04* (2013.01); *A43B 23/021* (2013.01); *A43B 23/025* (2013.01); *A43B 23/028* (2013.01); *A43B 23/0295* (2013.01)

(58) Field of Classification Search
CPC ..... A43B 3/26; A43B 23/027; A43B 23/0295
USPC ..... 36/97
See application file for complete search history.

(56) References Cited

U.S. PATENT DOCUMENTS

| | | | | |
|---|---|---|---|---|
| 252,778 | A * | 1/1882 | Klein | A43B 23/28 36/10 |
| 537,627 | A * | 4/1895 | Bixby et al. | A43B 3/101 36/8.2 |
| 797,966 | A * | 8/1905 | Lange et al. | A43B 3/101 36/8.2 |
| 2,132,523 | A * | 10/1938 | Berry | A43B 3/16 36/7.3 |
| 3,389,481 | A * | 6/1968 | England | A43B 3/30 36/97 |
| 2002/0078591 | A1* | 6/2002 | Morrone | A43B 5/12 36/8.3 |
| 2004/0107604 | A1* | 6/2004 | Ha | A43B 1/0018 36/97 |
| 2014/0041256 | A1* | 2/2014 | Espinola | A43B 3/26 36/97 |
| 2014/0259774 | A1* | 9/2014 | Minden | A43B 3/26 36/97 |

* cited by examiner

*Primary Examiner* — Ted Kavanaugh
(74) *Attorney, Agent, or Firm* — Saul Ewing Arnstein & Lehr LLP

(57) ABSTRACT

The invention is a high heel shoe with an upper that will provide comfort and flexibility for the wearer. In a preferred embodiment the upper consists of two at least two materials: 1) a firm fabric, such as leather, that will hold the shape of the design and have limited flexibility; 2) a flat knitted elastic, such as knit elastic, which will not narrow, or not narrow significantly, when stretched. In addition, the firm fabric is configured to have a flex-point and in a preferred embodiment is formed of two pieces of the firm material having a "split" between them providing the desired flex-point.

3 Claims, 6 Drawing Sheets

SHOE WITH FLEXIBLE UPPER

CROSS-REFERENCE TO RELATED APPLICATIONS

This application is based on, and claims priority to, U.S. Provisional Application No. 62/553,321, filed on Sep. 1, 2017, the entire contents of which being fully incorporated herein by reference.

BACKGROUND OF THE INVENTION

Field of the Invention

The present invention relates generally to shoes and more specifically to a shoe having an upper made of at least two materials, one of which includes a flexion point and another of which comprises an elastic material, each of which combine to enable greater comfort to a wearer.

Description of the Related Art

High heel shoes are a common staple within fashion, particularly women's fashion, and have been for centuries. Shoes having high or heightened heels are stylish while also aesthetically pleasing. The high heel height can elongate or at least create the illusion of elongating the leg. The high heel can also increase the height of the wearer. This increase in height and leg length can be appealing to the wearer of the shoe while also being aesthetically pleasing and fashionable to others. Women in particular wear high heel shoes to project an image or appear formal and fashion-forward.

High heel shoes come in many different shapes, sizes, colors and styles. Heel height and shape can also vary significantly amongst high heel shoes. A common characteristic of high heel shoes is one in which the heel portion of the foot sits higher than the toe portion of the foot, creating a downward sloping angle of the foot when worn inside of the shoe.

When walking in high heel shoes, a significant amount of pressure is placed on the ball of the foot, toes and toe joint region. As opposed to a shoe without a high heel, where the body weight is typically distributed proportionately throughout the foot, a high heel shoe will distribute weight almost entirely on the ball of the foot and toe region.

Furthermore, the shape of a high heel shoe is oftentimes then in direct contrast to the shape of a human foot. In most human feet, the front of the foot, or toe and toe joint region, is generally wider than the back of the foot, or heel and heel region. The toe region and toe joints, in most cases, are actually the widest part of the foot. This shape does not typically correspond to the shape of most high heel shoes, which are usually either essentially uniform in width throughout the length of the shoe, or only slightly wider at the toe portion of the shoe.

As a result, the shoe is usually either too tight for the toe region, causing discomfort, pain and blistering upon wear. Or the wearer may order a wider pair to accommodate the need for enhanced width. In that case, the shoe is produced in a wider format throughout, making the heel and midsole area wider, too. In this case, a wider shoe throughout may be too wide or large for the heel and midsole, causing the foot and/or heel to slip out of the shoe, resulting in pain, discomfort or the inability to walk in the high heel shoe without confidence that the shoe will provide appropriate support.

A shoe that is too tight in the toe area can exert unnecessary pressure on the foot, causing pain, discomfort, blistering and in other cases serious medical problems, including bunions. A high heel shoe exacerbates this problem by forcing the wearer to walk almost entirely on the ball of his or her foot, thus placing even more pressure on the toe area as it is confined within the shape of the shoe. Tight or ill-fitting high heel shoes can exacerbate bunions, for example, and the corresponding pain and discomfort that they cause.

Some wearers of high heel shoes seek to stretch the toe portion of the shoe to better accommodate a wider toe area. High heel shoes made of leather, for example, can be stretched slightly using forms of heat and molding techniques. In this case, however, the shoe may become too wide as it stretches on its own, with normal wear and tear. If the shoe stretches too much, it will become deformed and unsightly, diverging from its original sleek shape and look. On the other hand, the shoe may not be able to be stretched wide enough to accommodate the foot, particularly the toe joint area.

The pain and discomfort caused by high heel shoes typically occurs as the wearer is standing or walking in the shoe and the foot exerts pressure on the shoe, resulting in friction and tension between the shoe and foot. In addition, the foot can swell after spending hours standing or walking, to the point that the foot no longer comfortably fits into the shoe, even though the shoe seemed to fit well initially. The high heel shoe is not typically constructed using a flexible material or flexible fabric to alleviate this discomfort. Furthermore, the construction of the high heel shoe does not typically involve other flexible components, as this would detract from the shoe's sleek style and shape.

The shoe industry is aware of this discomfort, but the prevalent and fashionable style of a high heel shoe is one that is narrow throughout, especially near the toe region. This narrowness can cause the wearer's foot to appear small or petite, which is a style and look that has been common in high heel shoes. The containment of the foot in a narrow shape allows the wearer's foot to fit this popular trend of sleek style and attractiveness.

Some high heel shoes offer areas of flexibility or flexible fabric to alleviate this discomfort. Elastic material, for example, has characteristics of flexibility and revertibility, so that it can allow for flexibility while retaining its original shape. It allows the shoe to expand as the foot enters and is placed into the shoe. The amount of expansion depends on the need of the wearer and may vary from wearer to wearer.

The issue with an entirely flexible or elastic shoe, or portions of flexibility or flexible fabric, is that the shoe can often take the shape of the wearer's foot, at least in the portions of the shoe with the flexible fabric, because the flexible material in these prior art shoes is the only material located at its location. Since the flexible material is not more rigid like typical shoe leather, it conforms to the shape of the portion(s) of the foot adjacent to it when worn. The shoe can look odd if not even unsightly as it takes the shape of the foot, which is contrary in style and trend to the narrow, sleek look of a high heel shoe. Furthermore, flexible fabric, if placed directly against the foot, which is the case for most prior art styles of this manner, will actually take the shape of the toes or unsightly joints and bunions. The wearer will then be exposing the exact shape of their foot, or at least a portion of his or her foot, to others. Other high heel shoes may offer extended width in the toe region to better accommodate the foot. Their shoes, however, are contradictory to the popular style of a high heel, as they are significantly wider at the toe than at the heel.

Another issue with the lack of flexibility in a high heel shoe is the containment of the foot within a solid piece of fabric or material used to line the outside of the foot. Most high heel shoes do not contain multiple pieces of interconnected fabric; instead it is one continuous piece of fabric that creates a uniform style around the outside of the shoe. This results in one "topline" or top seam of the high heel shoe, which runs around the foot, from the back of the heel to the top of the foot. This single seam does not typically stretch and offers minimum flexibility, causing discomfort on other areas of the foot besides the toe region. The back of the heel, or Achilles' tendon area, for instance, can often blister due to the rubbing of an inelastic seam against the skin.

The issue of offering width, flexibility and comfort in a high heel shoe that conforms to the popular sleek appearance, look and style that has persisted in high heel shoes for many decades is a significant dilemma. The wearer is either faced with wearing an unsightly shoe that offers marginal comfort, oftentimes only in certain areas of the foot, or an attractive shoe, which often does not accommodate the foot, resulting in pain and discomfort.

SUMMARY OF THE INVENTION

The invention is a high heel shoe with an upper that will provide comfort and flexibility for the wearer. In a preferred embodiment the upper consists of two at least two materials: 1) a firm fabric, such as leather, that will hold the shape of the design and have limited flexibility; 2) a flat knitted elastic, such as knit elastic, which will not narrow, or not narrow significantly, when stretched. In addition, the firm fabric is configured to have a flex-point and in a preferred embodiment is formed of two pieces of the firm material having a "split" between them providing the desired flex-point.

In an embodiment, the shoe comprises an insole; an outsole; and an upper, said upper comprising a toe-end and a heel-end, said toe end and said heel end constructed with a flex-point located between said toe-end and said heel-end along a medial side of the upper, which flex-point enables flexion to occur between said toe-end and said heel-end; and an elastic element coupling said toe-end and said heel-end such that said elastic element urges said toe-end and said heel-end towards each other.

In an embodiment, the flex-point comprises a split-opening between said heel-end and said toe-end, defining a first edge of said heel-end adjacent to and overlapping a second edge of said toe-end. In another embodiment, the first edge and the second edge are connected to each other along a lower portion of the first and second edges. In still another embodiment, the elastic element is coupled to said heel-end between the insole and the outsole, and to said toe-end at the second edge. In a further embodiment the lower portion where the first edge and second edge are connected comprises the area of each between the insole and approximately half the length of the second edge. In yet another embodiment, the length of the first edge is smaller than the length of the second edge.

DETAILED DESCRIPTION OF THE INVENTION

Terminology

High heels shoes typically consist of:

I) Upper—holds the shoe onto the foot and connected to the outsole.

II) Insole—perimeter stitched to upper forming bottom of interior portion.

III) Outsole—leather or rubber material lining the bottom of the shoe, affixed to the insole.

IV) Topline—top edge of the upper.

V) Heel—provides support for the heel of the foot.

VI) Lining—covers the inside seams of a shoe, on the inside of the upper.

There are three segments or portions of the high heel shoe:

Toe-end—end closer to the wearer's toe, it can take on many different shapes but is traditionally either pointed, rounded or squared in nature.

Heel-end—end closer to the wearer's heel, where the upper and insole attach to the heel.

Midsole—between the two ends of the shoe, approximately beneath the arch of the foot (between the toe and heel).

The invention is a high heel shoe with an upper that provides comfort and flexibility for the wearer. An upper of a typical high heel shoe consists of one solid, continuous piece of fabric, often leather, that covers the shoe and holds the shoe onto the foot. The topline is typically a constant seam around the perimeter of the shoe, as it is contained on the upper.

In the claimed invention, the upper consists of at least two materials: 1) a firm fabric, such as leather, that will hold the shape of the design and have limited flexibility, and which is configured in a "split" arrangement to provide the flex-point; and 2) flat knitted elastic, such as a two to three inch wide knit elastic, which will not narrow, or not narrow significantly, when stretched.

In the preferred solution, the upper consists of a kid skin leather and "China Soft" knit elastic, but other materials may be used. Instead of leather, other firm fabrics that have characteristics of limited flexibility, including but not limited to synthetic or a microfiber leather as well as suede or a faux suede materials, can also hold the shape of the intended design. Instead of knit elastic, other material or elastic fibers may be used that have characteristics of stretching beyond its original shape while reverting to its original form when in a resting state.

Figure 1B:
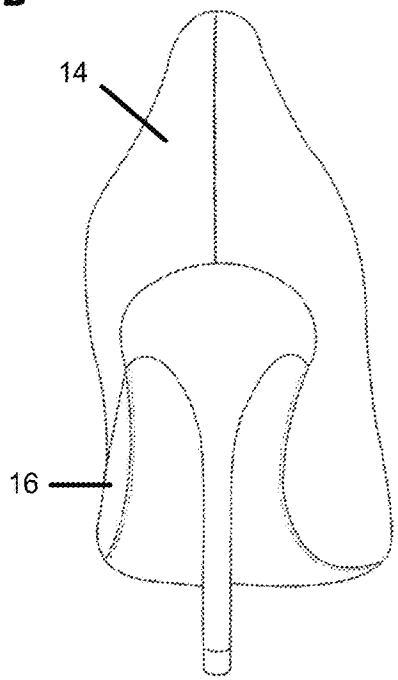
FIG. 1B is a rear view of the shoe of FIG. 1A.
Figure 1A:
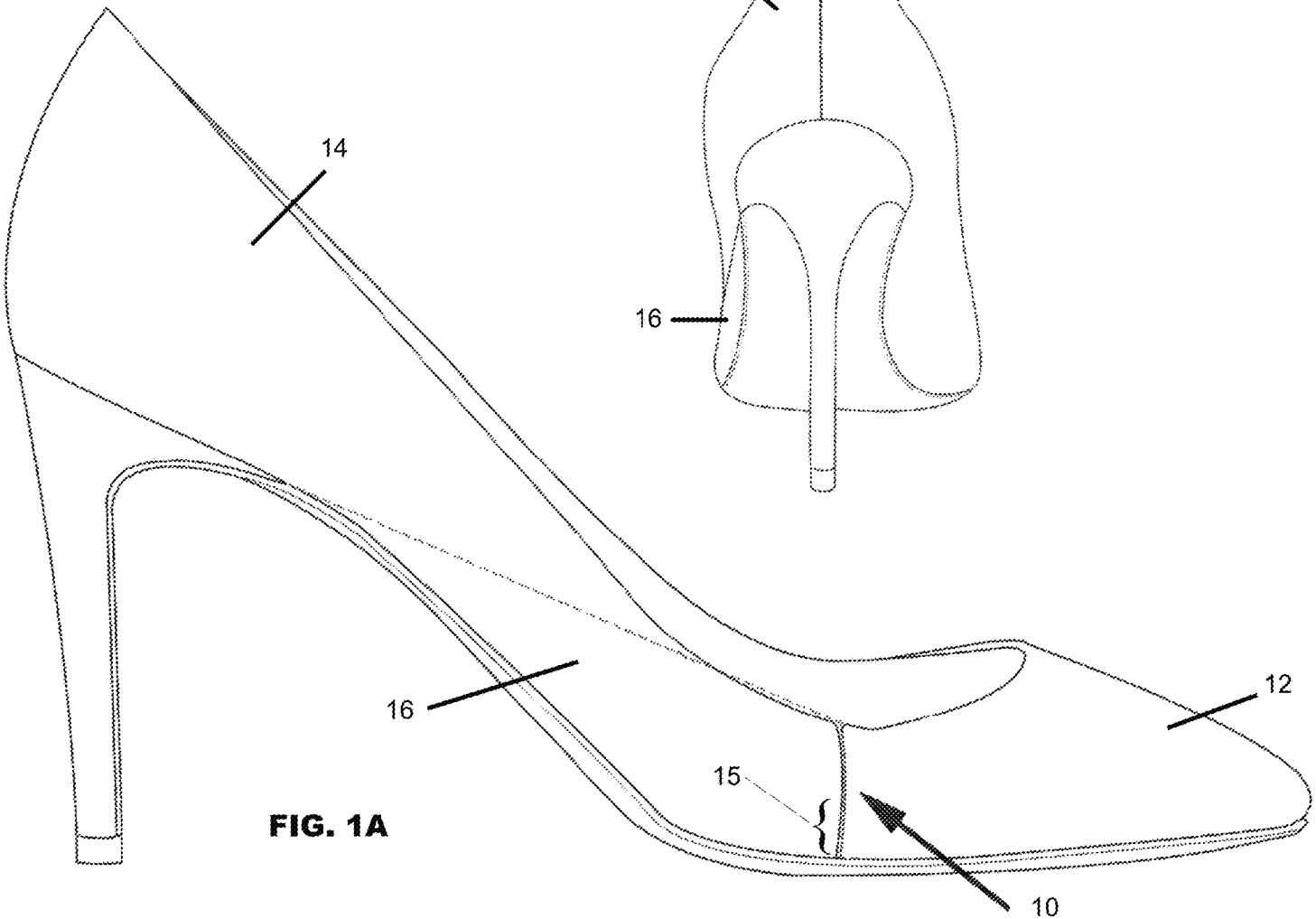
FIG. 1A shows a side perspective view of a first embodiment of a high heel shoe according the claimed invention.

FIG. 1A shows a side perspective view of a first embodiment of a high heel shoe according the claimed invention, with dashed lines to show the positioning of an elastic element 16 (removed in FIG. 1 so that the entirety of the upper can be more easily visualized) in relation to the upper as further described below. FIG. 1A shows the right side of a left shoe, and for the purpose of this application this visible side of the upper in FIG. 1A is referred to as the inside wall of the upper (i.e., the medial side of the upper).

The upper comprises two separate sections 12 (the toe-end) and 14 (the heel-end) separated by split-opening 10 creating a flex-point, and this split-opening 10 is sometimes referred to herein as an "upper division" to describe the fact that it is a dividing point of the two sections of the upper. In a preferred embodiment the split-opening 10 is located towards the base of the shoe, more towards the toe-end of the sole (insole and outsole) as shown in FIG. 1A. It is situated in this embodiment approximately where the ball of the foot meets the instep of the foot, on the interior side of each shoe. This split-opening 10 provides a flex-point that, when the edges of heel-end 14 and toe-end 12 (first edge 11A and second edge 11B, respectively) are connected, allows the upper to expand without tearing as pressure is placed on the upper by the foot, thus allowing for additional room for the foot, and for movement of the foot, within the interior of the shoe. The split-opening 10 also eases pressure on the foot itself as the topline is no longer one constant edge/seam containing the foot.

Figure 1C:
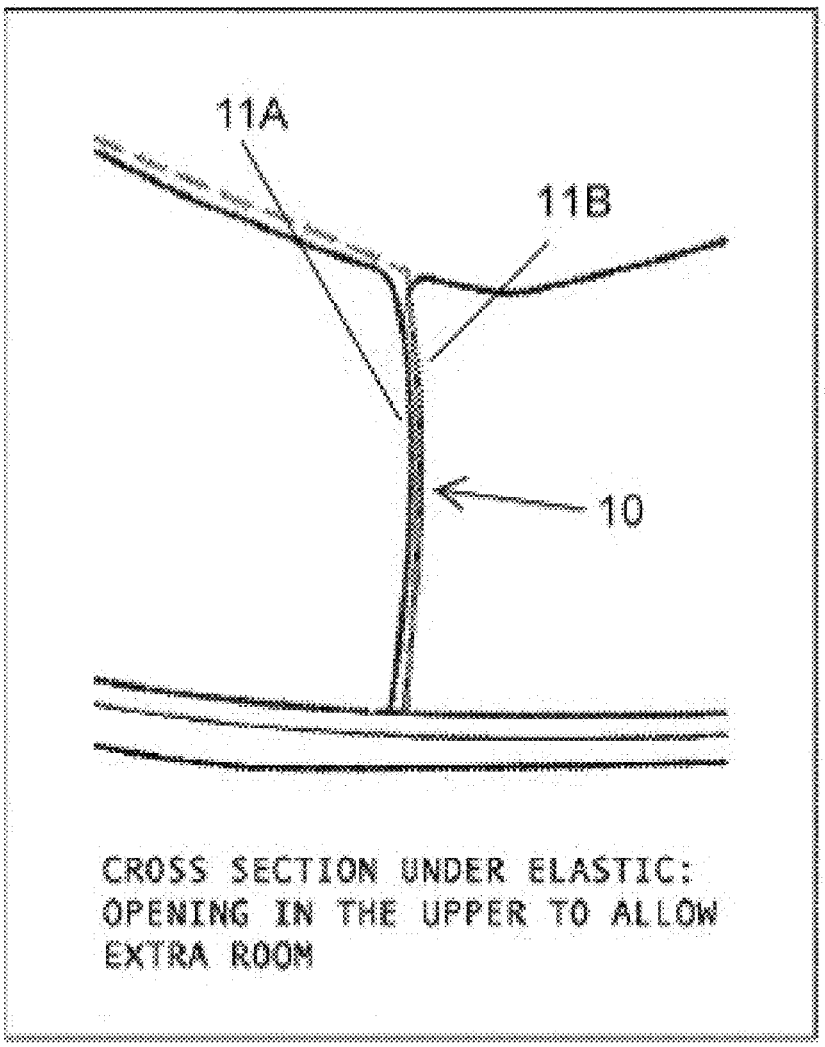
FIG. 1C shows the toe end (element 12) of the upper is constructed by dividing the upper in a manner perpendicular to its topline.
Figure 2B:
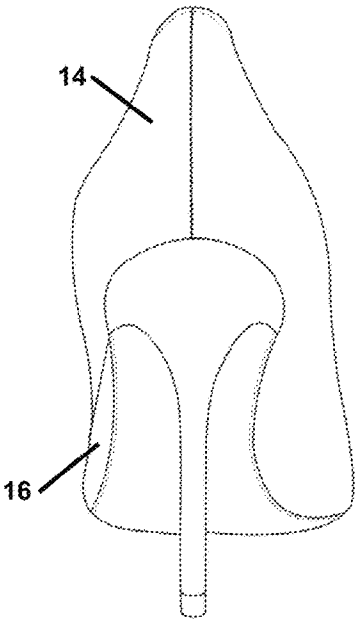
FIGS. 2A-2C show the end of section 14 along upper division 10 is shorter in length than the length of the end of section 12 along the upper division 10.
Figure 2A:
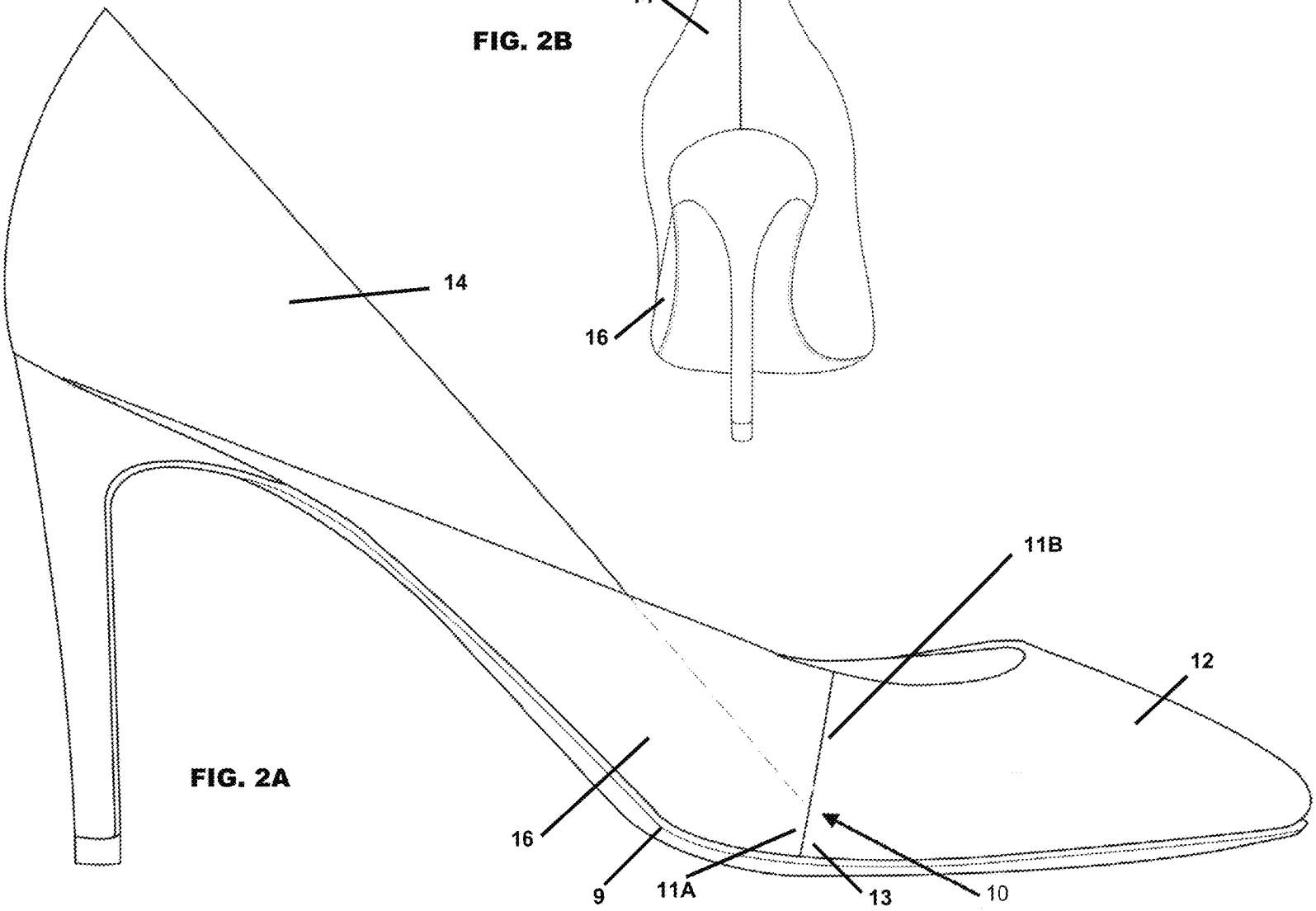
Figure 2C:
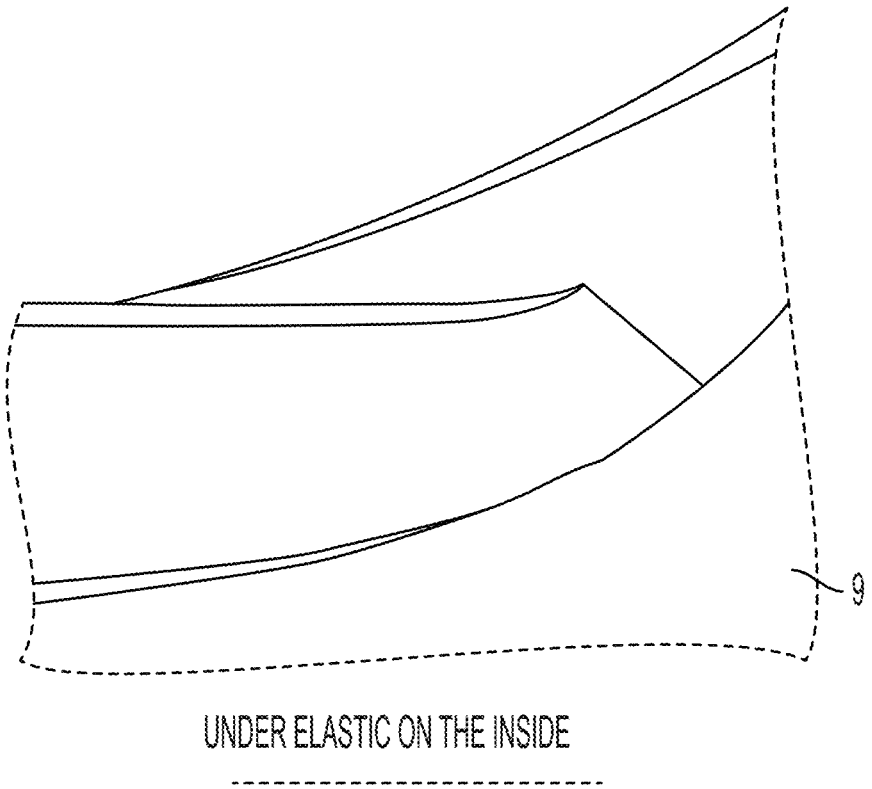

In a preferred embodiment the split-opening 10 is constructed as follows:

The toe end 12 of the upper is constructed by dividing the upper in a manner perpendicular to its topline as shown in FIGS. 1A and 1C. This end of the split-opening 10 is at the toe-end of the shoe and runs from its topline to the sole or bottom of the shoe. The perpendicular division is a feature of the preferred embodiment but it is understood that the shape of the split-opening 10 may take other forms.

The heel end 14 of the upper is constructed such that the topline slopes essentially parallel to the insole 9, at an angle and length that will allow it to slightly overlap with toe-end 12 such that they can be connected or affixed together along the common points where they overlap (overlap not shown in FIG. 1A for simplicity of explanation). The heel end 14 also runs from its topline to the sole or bottom of the shoe as shown.

The two sides of the split-opening 10 are connected or affixed together at the points where heel-end 14 meets toe-end 12, from toe-end 12's topline to the insole 9, preferably at a point beginning at the insole 9 and extending upwards to a point approximately halfway long the common overlapping edges of toe-end 12 and heel-end 14, illustrated by numeral 15 in FIG. 1A. This creates an attached portion on the insole side of split-opening 10, and an unattached portion above the approximate halfway point (extending from the approximate halfway point, up to the toplines). This configuration results in a flex-point or gap where the common edges of toe-end 12 and heel-end 14 are unattached. Each of toe-end 12 and heel-end 14 has its own corresponding topline. In a preferred solution, the end of the split-opening 10 of heel-end 14 (where it abuts with toe-end 12) is slightly thinner than the rest of the upper, so that the impact of having a double-section of material where the two attach is minimized. This thinning can be accomplished using, for example, a skiving machine or manual pressure. This feature is not necessary for the invention but may increase the comfort to the wearer.

Figure 3:
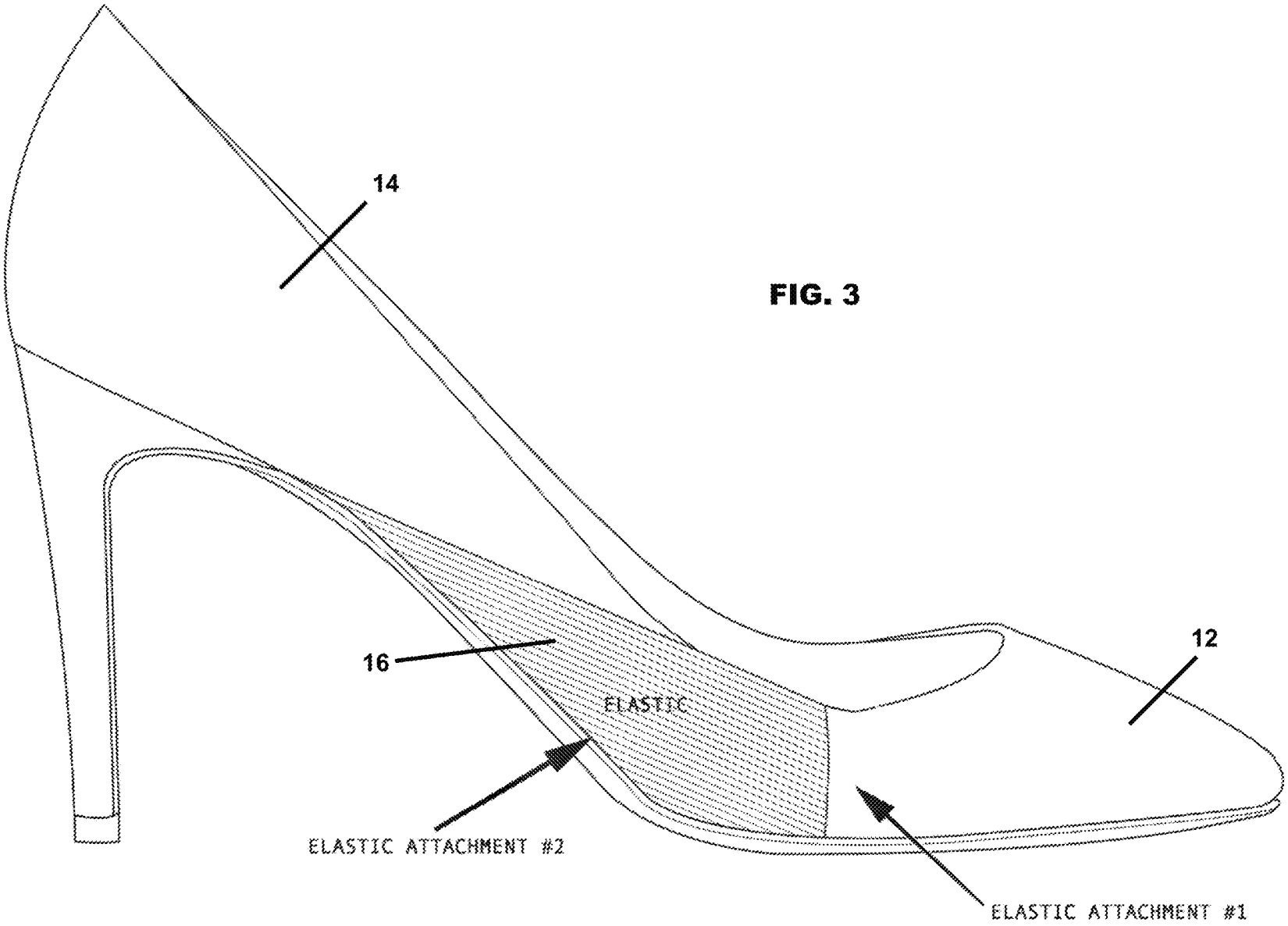
FIG. 3 is a view of FIG. 1A where the elastic element is visible.
Figures 4A, 4B:
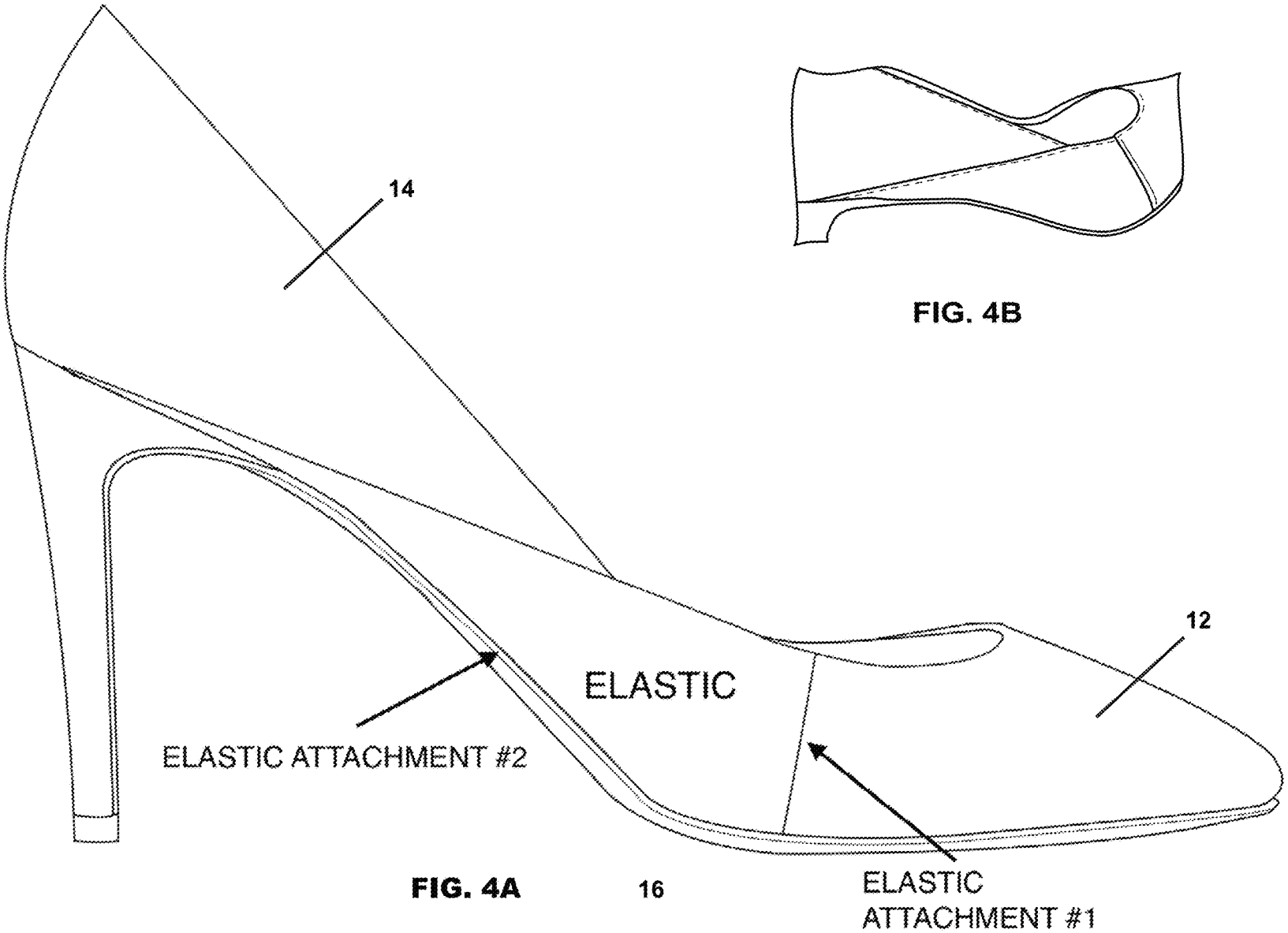
FIG. 4A is a view of FIG. 2A where the elastic element is visible.
FIG. 4B is a close up of the elastic element of FIG. 4A.

In a preferred embodiment illustrated in FIGS. 2A-2C and FIGS. 4A and 4B, the first edge 11A of heel-end 14 along split-opening 10 is shorter in length that the length of the second edge 11B of toe-end 12 along the split-opening 10. In this configuration, the entire length of the first edge 11A of heel-end 14 can be connected or affixed to the lower portion 13 of the second edge 11B of toe-end 12, as shown. This provides a similar flex point to that created by leaving the approximate half length of the meeting point of heel-end 14 and toe-end 12 unconnected to form the gap illustrated in FIGS. 1 and 3.

It is understood that heel-end 14 may attach to toe-end 12 at other points on the perpendicular edge between toe-end 12's topline and the sole or bottom of the shoe. In the embodiments shown, the split-opening 10 and each side of the split-opening 10 runs from its respective topline to the sole or bottom of the shoe, but it is understood that the two sides of the split-opening 10 do not necessarily need to be connected or affixed to one another if the wearer seeks additional flexibility in the upper. Additional material with either flexible or inflexible features may be used depending on the level of flexibility and stretch necessary for the wearer. As stated above, the shape of the split-opening can take many forms and can vary in length.

FIGS. 2 and 4 show that at the elastic element 16 is attached to the upper at two points: 1) to the upper, at the edge portion of toe-end 12 (e.g., extending across the split-opening 10) (Elastic Attachment #1), and 2) between the shoe's insole and outsole at the midsole (Elastic Attachment #2). This attachment leads to entire edge of heel-end 14 along the split-opening 10 to be completely covered by elastic.

The elastic element 16, identified as such in FIGS. 2 and 4, is connected to the upper, at the split-opening 10, and then runs parallel to the insole and outsole at the toe-end 12 of the shoe, or parallel to the surface when the shoe is placed on a flat surface. When walking or standing on the shoe, the elastic element 16 will be parallel to the ground itself. FIGS. 2 and 4 show the elastic element 16 attaching to the upper at the split-opening 10, but it is understood that the elastic element 16 can also connect to the upper in front of the split-opening 10, or closer to the toe end 12 of the shoe at a point outside of the split-opening 10.

The other end of the elastic element 16 is connected to the shoe at the midsole and affixed between the insole and outsole of the shoe. The elastic element 16 is affixed to the shoe such that it completely covers the split-opening 10, not revealing the slight gap in the split-opening 10. The elastic element 16 completes the upper so it completely contains the foot within the interior of the shoe.

The elastic element 16 laid over the fabric of the upper at the split-opening 10 allows the shoe to expand for comfort while maintaining the silhouette and shape of a sleek and attractive high heel shoe. Elastic element 16 will stretch to allow the shoe to expand, and the shoe will become flexibly adaptive to the wearer, while at the same time the upper will support and contain the foot in the high heel shoe's intended shape. The elastic element 16 will also revert to its existing shape when no pressure is applied, so the shoe will not stretch out over time or after extensive wear. The elastic element 16 will stretch based on the needs of the wearer as pressure is applied to the upper. Such pressure may be based on the width of the wearer's toes, toe joints or even irregularities in the foot. The expansion will occur to a point that is comfortable while also maintaining the intended sleek shape of the high heel shoe.

Although the present application uses the term "high heel shoe", it is understood that the term is considered to encompass other articles of footwear as well, such as but not limited to flats, or shoes without high heels, or other footwear in which the wearer can benefit from expansion without significantly compromising the intended shape of the footwear.

Although the preferred embodiment and accompanying Figures show the split-opening 10 at one point, it is understood that the split-opening 10 may sit at any point on the shoe, such as on the part of the shoe that sits on the inside of the foot. It is also understood that the shoe may contain more than one split-opening 10, or split-openings at multiple points on the shoe. One example of this is two split-openings, one on the inside of shoe and one on the outside of the shoe, placed at corresponding points such that they rest on the outside of both the leftmost and rightmost toe joints.

The invention claimed is:

1. A shoe comprising:

an insole;

an outsole; and an upper, said upper comprising:

a toe-end and a heel-end, said toe end and said heel end constructed with a flex-point located between said toe-end and said heel-end along a medial side of the upper, which flex-point enables flexion to occur between said toe-end and said heel-end; and an elastic element coupling said toe-end and said heel-end such that said elastic element urges said toe-end and said heel-end towards each other;

wherein the flex-point comprises a split-opening between said heel-end and said toe-end, defining a first edge of said heel-end adjacent to and overlapping a second edge of said toe-end;

wherein the first edge and the second edge are connected to each other along a lower portion of the first and second edges;

wherein said elastic element is coupled to said heel-end between the insole and the outsole, and to said toe-end at the second edge.

2. The shoe according to claim 1, wherein the lower portion where the first edge and second edge are connected comprises the area of each between the insole and approximately half the length of the second edge.

3. The shoe according to claim 2, wherein the length of the first edge is smaller than the length of the second edge.

* * * * *